United States Patent [19]

Berghefer

[11] Patent Number: 5,044,098

[45] Date of Patent: Sep. 3, 1991

[54] IMPLEMENT INTERFACE

[76] Inventor: Ray A. Berghefer, 435 Hecla St., Laurium, Mich. 49913

[21] Appl. No.: 441,752

[22] Filed: Nov. 27, 1989

[51] Int. Cl.[5] ..... E01H 5/06

[52] U.S. Cl. ..... 137/232; 37/236; 267/249

[58] Field of Search ..... 267/4, 166, 170, 249, 267/71; 37/231, 232, 234–236

[56] References Cited

U.S. PATENT DOCUMENTS

| | | | |
|---|---|---|---|
| 1,701,746 | 1/1929 | Cook . | |
| 2,144,118 | 1/1939 | Mitchell | 267/249 X |
| 2,242,826 | 5/1941 | Keeler | 37/232 X |
| 2,565,337 | 8/1951 | Allan | 37/144 |
| 2,645,866 | 8/1953 | McGee | 37/144 |
| 2,694,267 | 11/1954 | Donnelly et al. | 37/42 |
| 3,400,475 | 1/1968 | Peitl | 37/42 |
| 3,432,946 | 3/1969 | Peitl | 37/42 |
| 4,279,084 | 7/1981 | Low et al. | 37/42 |
| 4,320,589 | 4/1982 | Pelazza | 37/42 |
| 4,439,939 | 3/1984 | Blau | 37/231 |

FOREIGN PATENT DOCUMENTS

| | | | |
|---|---|---|---|
| 264572 | 9/1968 | Fed. Rep. of Germany | 37/232 |
| 2230274 | 10/1973 | Fed. Rep. of Germany | 37/232 |
| 1112623 | 3/1956 | France | 267/249 |
| 85385 | 4/1955 | Norway | 37/232 |
| 213013 | 7/1941 | Switzerland | 37/235 |

*Primary Examiner*—Randolph A. Reese
*Assistant Examiner*—Arlen L. Olsen
*Attorney, Agent, or Firm*—Thomas D. Wilhelm

[57] ABSTRACT

An implement interface, comprising first and second spring actuators comprising respective first apparatus for attaching the interface to an implement and second apparatus for attaching the interface to a source of mechanical power. A spring is stressed between the spring actuators. The interface is adapted to apply downwardly directed force to the implement. Method of moving media is also disclosed.

3 Claims, 5 Drawing Sheets

IMPLEMENT INTERFACE

BACKGROUND OF THE INVENTION

This invention relates to implements attached to vehicles, and especially to implements which interact with the ground, or with a softer media on the ground.

The "ground" as used herein refers to natural soil surfaces, compacted soil surfaces; and artificial surfaces harder than natural soil surfaces, such as concrete and asphalt, and the like.

A "media" as referred to herein means any bulk or aggregate matter which can be moved, or otherwise acted upon, by the power available at the vehicle on which the implement is mounted. Typical of softer media is snow, sand, gravel, loose dirt, and the like. It is contemplated that the invention can also be applied in working with harder media such as virgin soil, coal, blasted stone, breccia, debris, and the like.

In preferred embodiments, the invention relates to plows and the like for moving snow. Accordingly, the invention is described herein with respect to snow plows, and moving snow with such plows.

Those skilled in the art will see that the invention herein can apply to other implements, and for interacting with, and working, media other than snow. Exemplary of such media are gravel, stones, dirt and the like.

Snow is commonly moved using trucks having a front mounted plow blade. Such plows normally are attached to the trucks, under the truck chassis, and near the front wheels, with a pair of attaching pins.

Typically the plow blade is lifted off the ground by a chain, one end of which is attached to the plow frame; and the other end of which is attached to a lift arm pivotally mounted on the truck. The lift arm is powered by a single-acting hydraulic cylinder/ram connected to the truck and to a portion of the lift arm remote from the truck. When the ram is powered, the lift arm is lifted, lifting the chain and, respectively, the plow blade. When the power is released from the ram, the weight of the plow blade takes it down to the ground. Accordingly, the effective weight at the edge of the plow blade is governed by the weight/mass, and the distribution of the weight/mass, of the plow.

If the snow is light, the weight, and typical shape, of the plow blade, are effective for moving the snow. If, however, the snow has been compacted, the weight of the plow is sometimes not sufficient to break up the compacted snow, whereby a compacted surface of snow is left on the ground after plowing. This is especially true of plows used on smaller trucks, such as pick-up trucks.

Another problem related to conventional snow plows mounted on trucks is related to driving the truck with the plow raised. The plow is typically raised when it is not being used for plowing, such as when traveling to a work site, or between jobs. In such cases, the plow is raised by lifting on the chain, and is held in the raised position while the truck is driven about, or to the next job site, or the like. At any rate, trucks having snow plows thereon are commonly driven from place-to-place with the plows raised, and held up by the chains.

While so traveling, when the truck hits a bump the plow can be thrown up by the force of the bump, enough that the chain is momentarily slack. When the plow comes back down, the momentum of the plow is suddenly absorbed by the chain as a shock, and transferred to the vehicle. Such a shock is hard on the vehicle suspension. It is also disruptive to control the vehicle, and so may be dangerous. Finally, when the plow is thrown up, and the chain is slack, it is possible for the chain to come loose from the lift arm of the truck, whereupon the plow impacts the road or ground unintentionally, causing severe handling of the vehicle.

It is an object of this invention to provide an implement interface which is adapted to apply a downwardly directed force to the implement, sufficient to enable an operator to adjust the effective operation of the implement.

It is another object of this invention to provide an interface which provides solid support of the lifted implement.

It is still another object of the invention to provide an interface wherein the resistance to throwing of the implement upwardly increases proportionate to upward travel of the implement from the lifted position.

It is yet another object to provide an interface wherein a force throwing the implement upwardly is counteracted by a compression spring on the interface, and wherein the spring is necessarily under compression at all conditions of operation of the interface.

Still another objective is to provide means and a method to apply a downwardly directed force on the working surface of the implement.

SUMMARY OF THE INVENTION

Some of the objectives are obtained in an implement interface comprising a first spring actuator, comprising first means for attaching the interface to an implement, a second spring actuator, comprising a second means for attaching the interface to a source of mechanical power, a spring between the first and second spring actuators, and an operating stop adapted to interact with both of the first and second spring actuators. The spring is adapted to urging the operating stop into engagement with one of the first and second spring actuators, to thereby provide solid support of the implement, in the absence of force urging the first and second attaching means toward each other.

Other objectives are obtained in a similar implement interface comprising the first and second spring actuators, and the spring, and wherein the resistance to moving the first and second attaching means toward each other increases as the first and second attaching means are moved toward each other.

Still other objectives are obtained in a similar implement interface comprising the first and second spring actuators and a compression spring, and wherein the spring is necessarily under compression at all conditions of operation of the interface.

Yet other objectives are obtained in an implement adapter which comprises a frame adapted to be attached to a vehicle, an implement interface as described above, and a ram attached to the frame, and adapted to interact with the interface and thereby stress the spring. The ram is properly positioned, having sufficient length of stroke, and sufficient power, to stress the spring, and the spring has sufficient strength, to apply an effective amount of downwardly directed force on the implement to enable an operator to adjust the effective operation of the implement.

The invention further comprises a vehicle having a mounting locus, an implement mounted to the vehicle at the mounting locus, and adapted to pivot about the mounting locus. The implement comprises an end thereof remote from the mounting locus, whereby the remote end describes an arc about the mounting locus upon pivotation of the implement about the mounting locus. The vehicle includes an implement adapter as above, the implement adapter being attached to the vehicle and to the implement, and wherein force exerted by the compression spring is directed in a line generally parallel to a straight line approximation of the arc described by the end of the implement during normal operation of the implement.

The invention further comprises a method of working a ground media, such as snow, gravel, stones, dirt and the like. The method comprises the steps of lowering a working surface of an implement, the implement being mounted on a vehicle, onto the ground media, the working surface being interactive with the ground media; applying from the vehicle through a compression spring, to the implement, a downwardly directed force of sufficient magnitude to multiply the effective weight of the implement, at the working surface, by at least 1.1 times the normal effective weight of the implement at the working surface, and moving the vehicle, and thereby working the media with the implement.

DETAILED DESCRIPTION OF THE ILLUSTRATED EMBODIMENT

Figure 1:
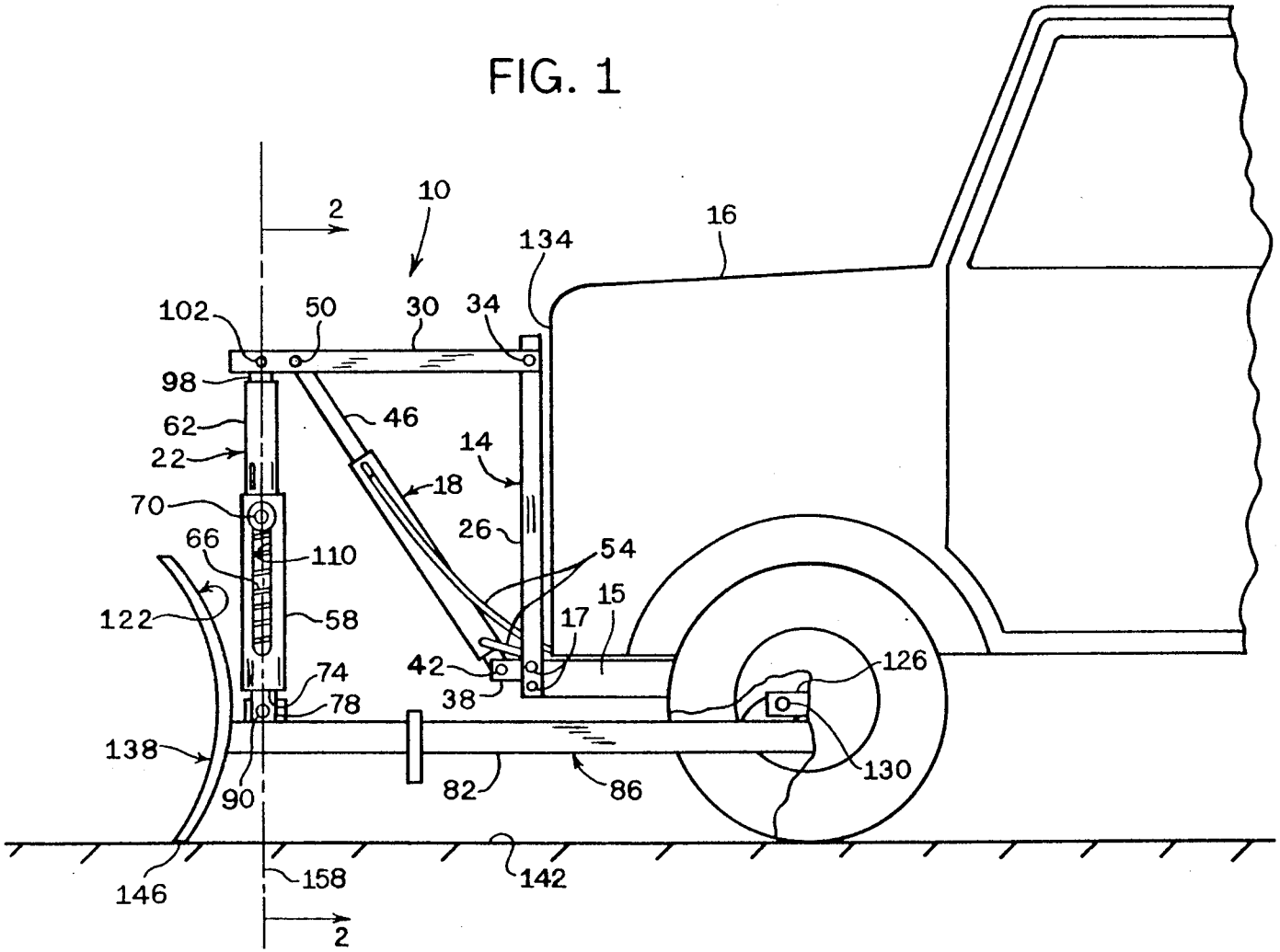
FIG. 1 shows a side view of a front portion of a truck, with a snow plow mounted to the truck, and using an interface of this invention; the plow resting on the ground in the float position.

Referring now to FIG. 1, implement adapter 10 includes a ram frame 14, fixedly mounted to frame 15 of truck 16 by bolts 17; a hydraulic ram 18, and implement interface 22. Ram frame 14 includes support arms 26, and an upper lift arm 30 pivotally mounted to the support arms 26 by pivot pin 34. Ram support bracket 38 is securely mounted to ram frame 14. Hydraulic ram 18 is pivotally mounted, at its lower end, to ram support bracket 38 by a pin 42. The piston 46 is pivotally mounted, at its upper end to lift arm 30 by pin 50. A pair of hydraulic lines 54 connect the hydraulic ram 18 to a hydraulic pump, not shown.

Implement interface 22 comprises a lower spring actuator 58, an upper spring actuator 62, a compression spring 66, and a stop bolt 70.

Figure 2:
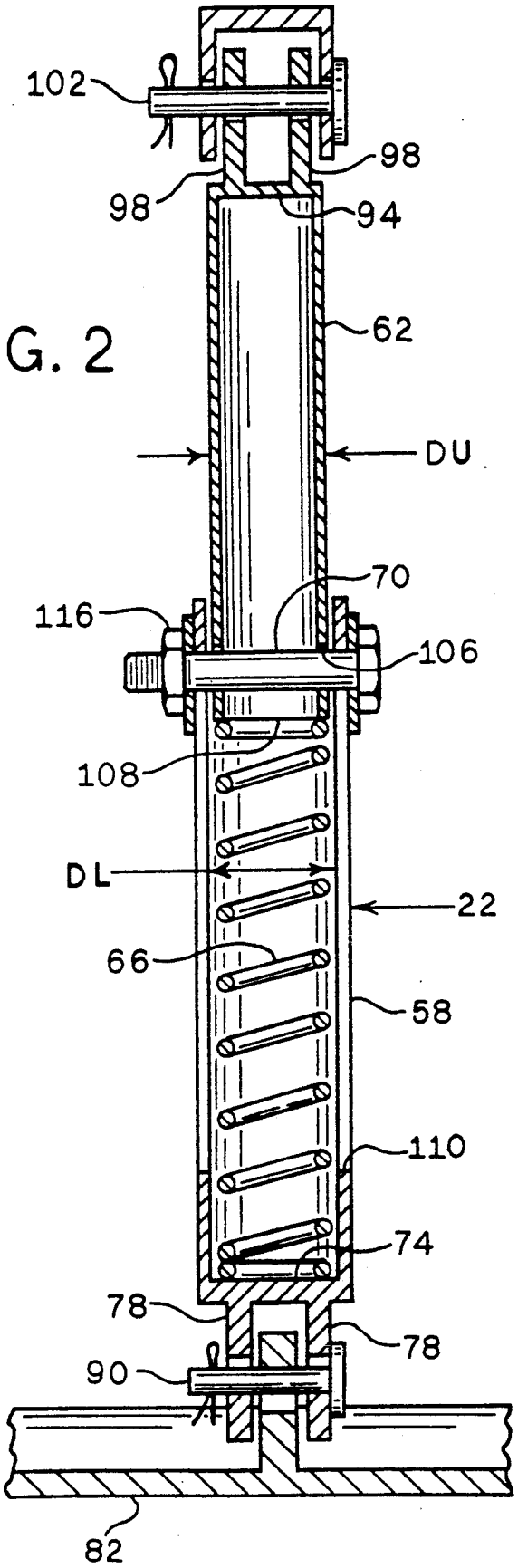
FIG. 2 shows a cross-section of the implement interface, and is taken at 2—2 of FIG. 1.

Referring now to FIG. 2, the lower spring actuator 58 comprises a hollow tube having a lower end 74 at its bottom. A pair of mounting lugs 78 extend from lower end 74. The lower spring actuator 62 is pivotally mounted to frame 82 of plow 86 by pin 90.

The upper spring actuator 62 comprises a hollow tube having an upper end 94 at its top. A pair of mounting lugs 98 extend from upper end 94, and pivotally mount the upper spring actuator 62 to lift arm 30 through pin 102. The outer diameter "DU" of the upper spring actuator 62 is slightly less than the inner diameter "DL" of the lower spring actuator 58, with a large enough clearance between DU and DL that the upper spring actuator slides easily inside the lower spring actuator, and a small enough clearance that both the upper and lower spring actuators act in a common direction. The relationship between DU and DL typically falls within the range of $$0.12 \text{ inch} \geqq DL - DU \leqq 0.38 \text{ inch.}$$

Upper spring actuator 62 has a pair of opposed holes 106 adjacent, but above its lower end 108. Lower spring actuator 58 has a corresponding pair of opposed slide slots 110. Bolt 70 extends through opposed holes 106 and opposed slots 110, as seen in FIG. 2.

Spring 66 is confined, and compressed, in lower spring actuator 58, between lower end 108 of the upper spring actuator 62 and lower end 74 of lower spring actuator 58.

Implement interface 22 is assembled as follows. Compression spring 66 is inserted into lower spring actuator 58. The lower end 108 of upper spring actuator 62 is then inserted into lower spring actuator 58. Upper actuator 62 is then pushed down, slightly compressing spring 66 until holes 106 can be lined up with slots 110. When holes 106 and slots 110 are aligned, stop bolt 70 is inserted through the holes 106 and slots 110 and secured with lock nut 116. The length of spring 66, the position of the upper end 118 of slots 110, and the positioning of opposed holes 106 are selected such that the spring 66 is slightly compressed, with a force easily supplied by an adult, before holes 106 line up with the upper end 118 of slots 110. Accordingly, spring 66 is necessarily always under some, even if light, compression in the assembled interface. Respectively, when so assembled, as in the illustrated embodiment, the spring 66 necessarily pushes against the lower end 108 of the upper spring actuator 62 with an expansive force, which pushes operating stop bolt 70 into engagement with upper ends 118 of slots 110, in the absence of force urging mounting lugs 78 and mounting lugs 98 toward each other. Thus the holes 106, the stop bolt 70, and the upper ends 118 of slots 110 prevent further distancing movement of the spring actuators, and maintain a restorative force in the spring at all conditions of operation of the interface.

Plow 86 comprises a frame 82 and blade 122. Plow frame 86 is pivotally mounted to a structural member 126 of the truck 16 by pins 130, at a location behind the front 134 of the truck, in the conventional manner. Working power for plowing with blade 122 is transmitted from the truck, through pins 130, through plow frame 82, to blade 122, and accordingly to the working surface 138 of the blade. Essentially none of the working power is transmitted through implement interface 22.

FIG. 1 illustrates the plow and the implement interface, with the interface in the float position. In that position, the ram 18 is not powered in either direction. Rather, the ram accommodates movement in either direction responsive to forces other than forces initiated in the ram. Spring 66 pushes operating stop bolt 70 against the upper end 118 of slots 110. Accordingly, blade 122 pushes down on hard ground surface 142 with the effective weight of the combination of the plow and the interface.

Figure 3:
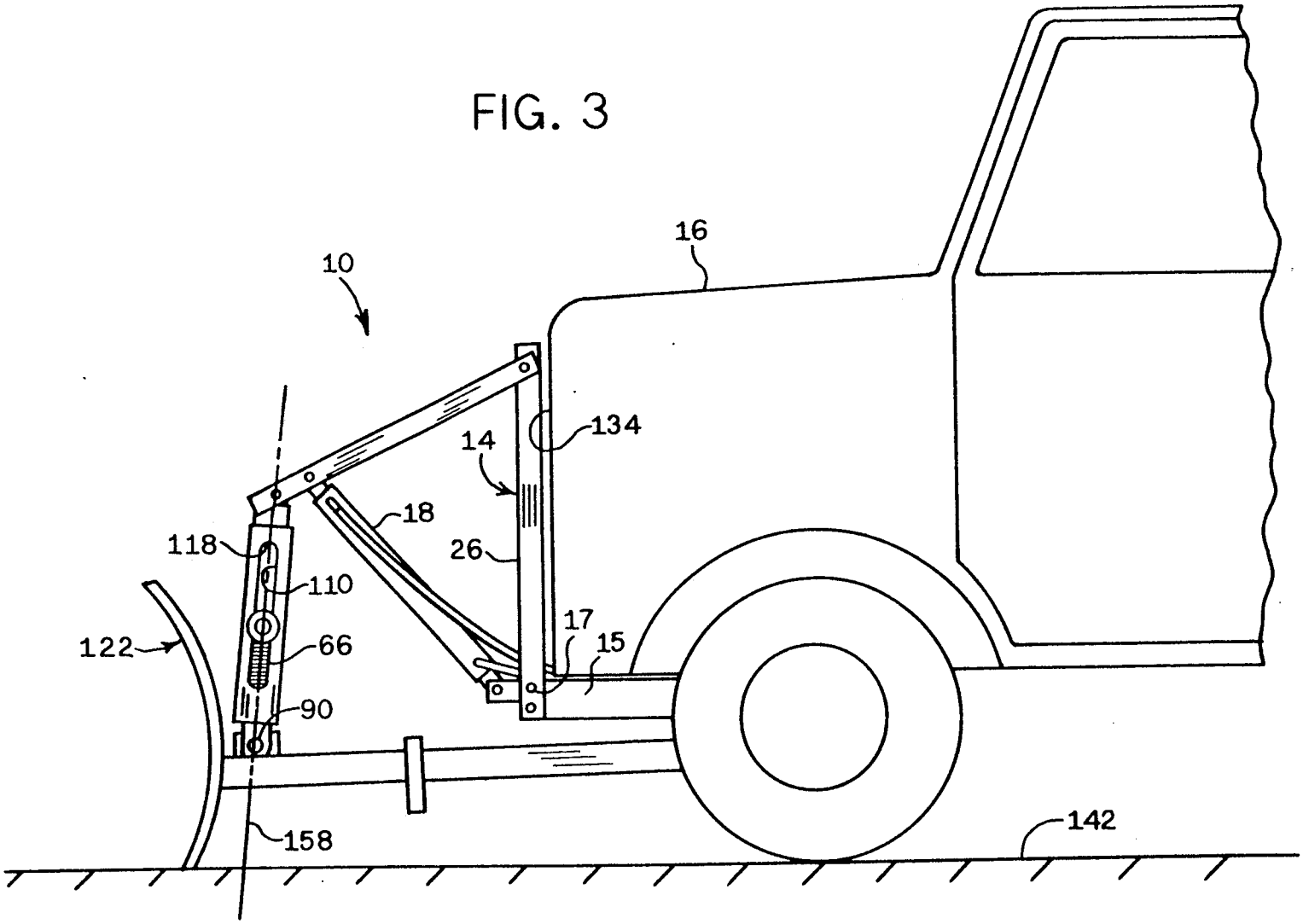
FIG. 3 shows a side view as in FIG. 1, but with full down pressure applied by the hydraulic ram.

FIG. 3 illustrates the plow and the implement interface in the full down-pressure position, wherein ram piston 46 has been fully retracted into the ram. This forces upper spring actuator 62 down into lower spring actuator 58, further compressing spring 66. The compressed spring 66 exerts its expansive spring force downwardly on the plow, and accordingly increased downwardly directed force is thus exerted by the lower contacting edge 146 of the working surface 138 of blade 122.

Ram piston 46 can be adjusted, from the full down position seen in FIG. 3, to any position between the full down position shown in FIG. 3 and the float position shown in FIG. 1. The position of piston 46 controls the degree of compression of spring 66, and accordingly the amount of force applied by spring 66 to the lower edge 146.

A typical spring 66 contemplated for use with, for example, a plow mounted on a pick-up truck has a compressive strength of about 110 lbs. per inch of compression. A typical distance of travel of upper spring actuator 62 (in compression of spring 66) between the float position of FIG. 1 and the full down position of FIG. 3 is about 5.5 inches. Accordingly, the spring 66 applies about 600 lbs. of force to plow 86 at pin 90. Accordingly, considering the lever arm operating between pins 130 and pin 90, and between pins 130 and lower edge 146, the 600 lbs. applied by spring 66 at pin 90 applies about 525 lbs. of downward force at lower edge 146. This increases by a significant amount (e.g. from 0% to up to about 150%) the downward force which can be applied at lower edge 146. The increased force can be applied selectively, to adjust the effective operation of the plow, and is particularly useful where the material to be moved has become packed or encrusted. For example, the increased downward force can be advantageous for breaking loose packed snow on a parking lot having a paved surface such as asphalt or concrete. Since the down pressure does increase ±:he sliding friction between lower edge 146 and ground surface 142, it will be used only as needed; whereby the selectivity of its use, and the capability to adapt the amount of force to the requirements of the media being moved, are important.

It is seen in FIG. 3 that, in the full down position of ram 18, wherein ram piston 46 is fully retracted, end 94 of upper spring actuator 62 still extends somewhat out of the top of lower spring actuator 58. Spring 66 is less than fully compressed. And there is adequate length to slots 110, below bolt 70, to permit further downward movement of bolt 70 relative to slots 110.

Figure 4:
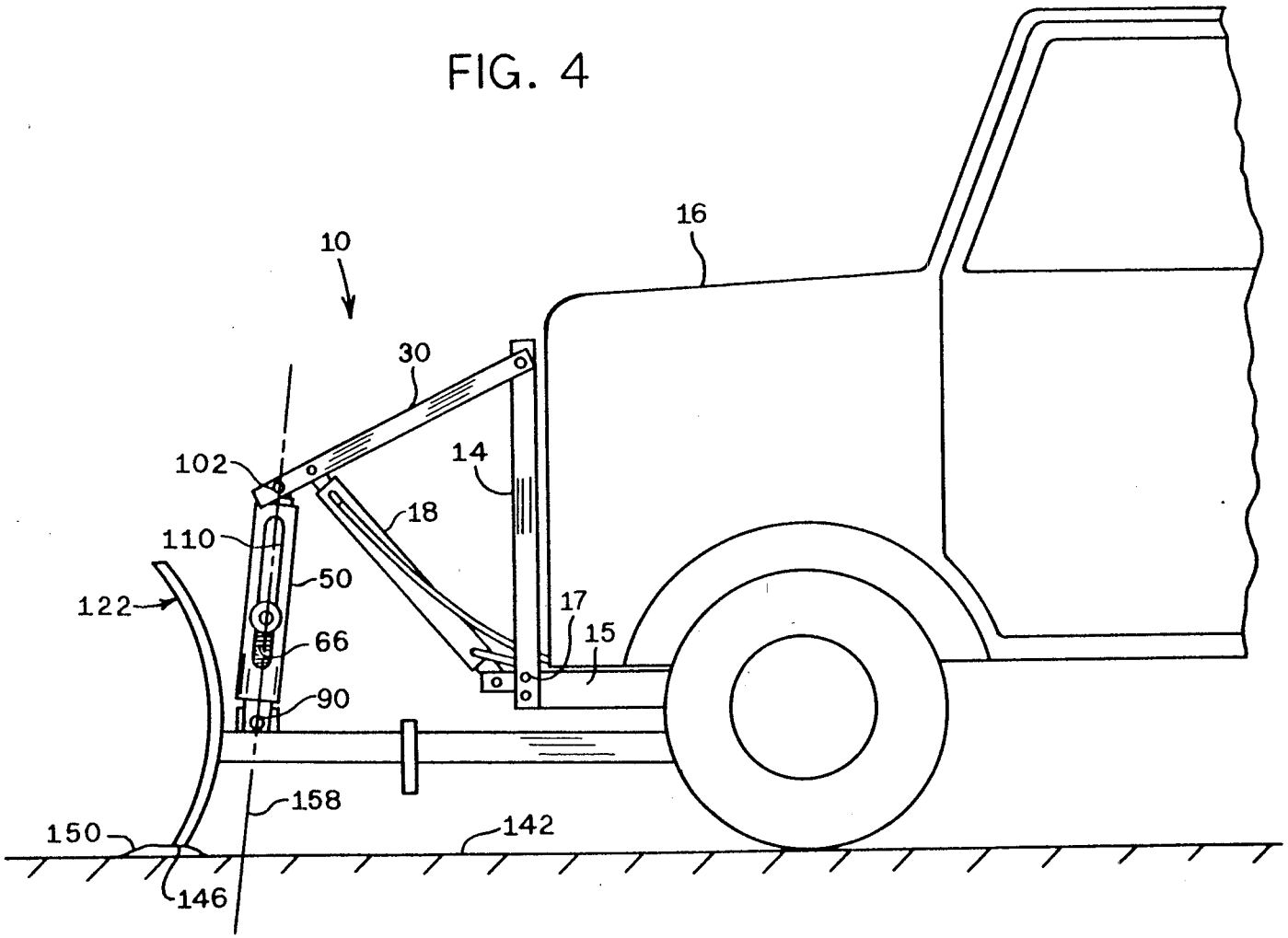
FIG. 4 shows a side view as in FIG. 3 where the plow, while under full down pressure of the ram, has been raised by interference with a low obstruction.

FIG. 4 illustrates the importance of the immediately foregoing conditions when the blade 122 encounters a low obstruction 150. As the lower edge 146 rides up over the obstruction 150 it forces lower spring actuator 58 upwardly, without a corresponding upward movement of lift arm 30. Accordingly, spring 66 is further compressed. Bolt 70 moves downwardly with respect to slots 110. And upper spring actuator 62 moves further downwardly with respect to lower spring actuator 58. The resulting position is seen in FIG. 4.

In principle, then, when downward pressure is being applied by ram 18, through spring 66, the rise and fall of blade 122 is accompanied by dynamic, and automatic, corresponding increases and decreases in the amount of expansive/downward force being applied by spring 66.

Effectively, the downward force applied by spring 66 amounts to a forward transfer of an equivalent amount of weight of the truck 16.

Figure 5:
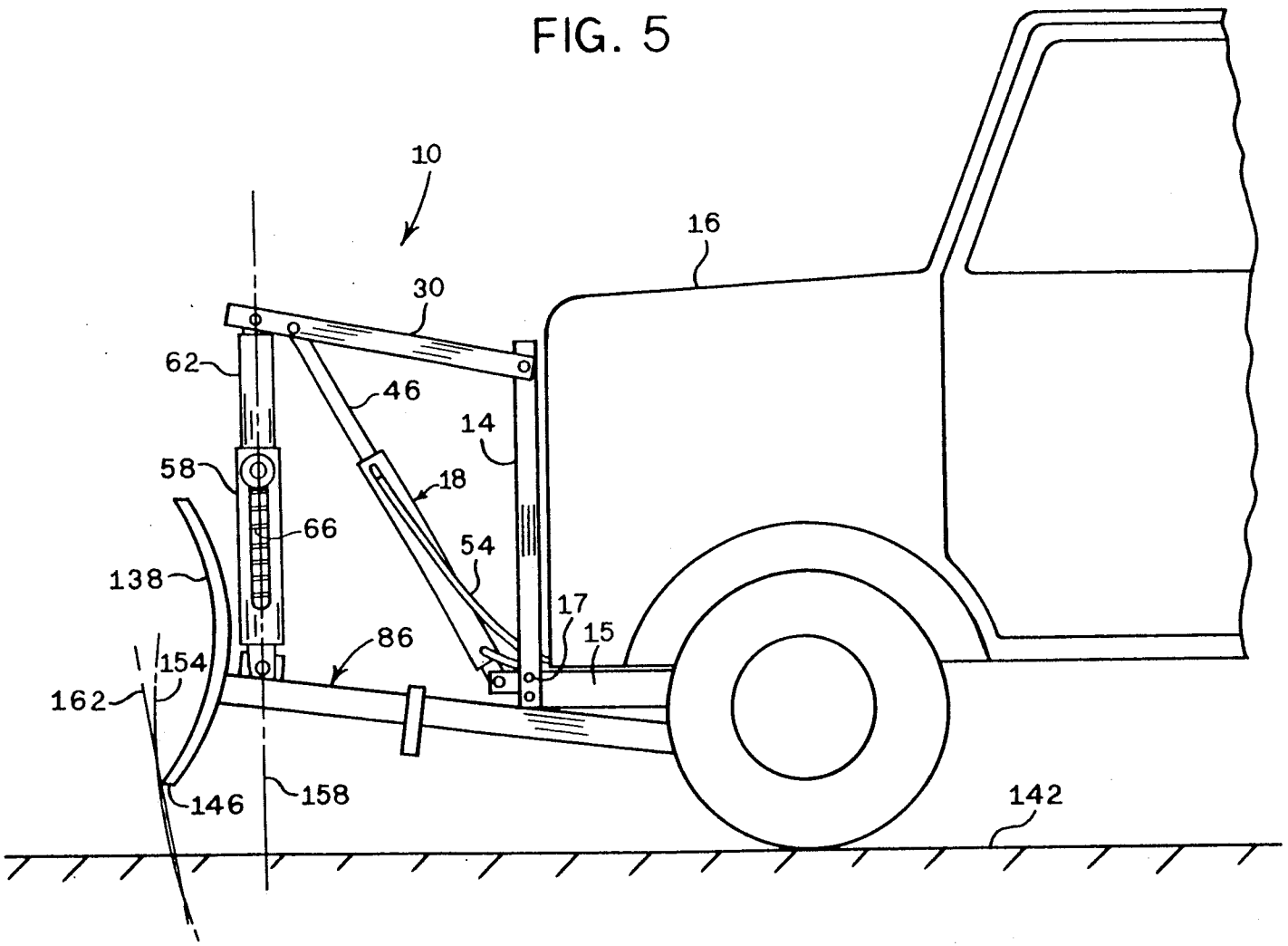
FIG. 5 shows a side view as in FIG. 1, with the plow in the normal raised, or transport, position.

When the plow is to be lifted, ram piston 46 is extended as shown in FIG. 5. As the ram piston 46 is extended from, for example, the position shown in FIGS. 3 and 4, it lifts arm 30, which lifts upper spring actuator 62 and correspondingly bolt 70. The process is aided by the conventional expansive forces exerted by compressed spring 66.

As operating stop bolt 70 reaches the top of slots 110, it reaches the limit of movement of the spring actuators 58 and 62 away from each other as it engages the upper ends 118 of the slots, thereby providing solid engagement between actuators 58 and 60 by means of bolt 70 as seen in FIG. 2. Upon still further lifting by lift arm 30, effected by the further extension of ram piston 46, bolt 70 is further lifted, which effects the lifting of lower spring actuator 58, and respectively the plow blade 122 as shown in FIG. 5.

The implement interface 22 of the invention demonstrates one of its chief advantages in the lifted/transport position illustrated in FIG. 5. Firs±., the interface provides solid, compressible support for the plow in the lifted position, from plow frame 82, through pin 90, to lower spring actuator 58; from spring actuator 58, at upper ends 118 of slots 110, through operating stop bolt 70 to upper spring actuator 62, through pin 102 to lift arm 30, through pin 50 to ram 18, through pin 42 to ram support tracket 38, through ram frame 14 to truck frame 15. Some support force also interacts through arm 30 and frame 14, through bin 34. And by design, even in its most extended position, shown in FIGS. 1 and 5, spring 66 is still slightly compressed from its fully extended relaxed position. So while the implement interface 22 provides solid lifting support, any force tending to lift blade 122 relative to lift arm 30 (e.g. the upward force caused by the truck tires hitting a bump) is resisted by the expansive forces applied by spring 66.

The amount of expansive force exerted by spring 66 depends in part on the distance between holes 106 and the lower end 108 of upper spring actuator 62. Accordingly, the amount of expansive force exerted by spring 66 as illustrated in FIG. 5 can be controlled by proper selection of the positions of holes 106.

In its transport position, compared to using the conventional lift chain which it replaces, the blade 122 cannot bounce freely when the truck hits a bump. The tendency to bounce is resisted by spring 66. Further, with secure mounting of interface 22 between pins 90 and 102, there is no possibility of the lifting means being thrown off of lift arm 30 when the truck hits a bump. As a result, the affect of the plow on the control and handling of the vehicle in the transport mode is reduced in this invention, in accordance with the reduction in the dynamic bouncing, and the like of the plow.

Blade 122 represents an end of plow 86 which is remote from the primary mounting locus of the plow at pins 130. As the remote end, e.g. lower edge 146 is raised and lowered such as between the positions illustrated in FIGS. 1 and 5, the plow pivots about pins 130, describing an arc of pivotation 154, illustrated in FIG. 5. As seen in FIGS. 1 and 5, the expansive force of spring 66 is exerted in a direction along longitudinal axis 158 through the center of spring 66. While the exact direction of longitudinal axis 158 varies somewhat according to the operating mode of the interface, and as seen in the several drawings, longitudinal axis 158, and accordingly the force of spring 66, is directed in a line generally parallel to a straight line approximation 162 of arc 154 during normal operation of the plow. As seen in the drawings, the direction of axis 158, also approximates a perpendicular with respect to the supporting ground surface 142. Accordingly, the effective force vector of the down-pressure added by spring 66, to the plow, approximates the full expansive force exerted by spring 66. Thus, the force of spring 66 is efficiently utilized to apply down-pressure at lower edge 146.

The extending and retracting of ram piston 46 is controlled by conventional controls normally associated with double acting rams. The controls are preferably inside the truck, and are generally located near the other hand controls which control the driving operations of the vehicle.

In using the invention to work a ground media, such as to move snow which is on the ground, the plow is lowered such that lower surface 146 engages the snow, and preferably penetrates through the snow to the ground surface 142. Additional downward force is applied, as needed, through spring 66, by retracting ram piston 46. The downward force is necessarily always resilient as received by the plow blade, since spring 66 is never fully compressed, except perhaps when the blade hits a larger obstruction.

With the plow lowered, the truck is then moved forward, effecting movement of the snow. If a layer of (hard or packed) snow remains, the down pressure is increased and the plowing is repeated. By observing the effectiveness of a certain amount of down pressure, the operator can select that optimum amount of down pressure which will clean off the snow without using more force than necessary—which would unnecessarily increase the friction between the ground surface 142 and lower edge 146.

A typical minimum amount of downward force which will adjust the effective operation of the implement is that amount which multiplies the effective weight of the implement, applied at the interactive working surface (e.g. edge 146) by about 1.1 times the normal effective weight of the implement at the interactive working surface. An intermediate amount of force multiplies the effective weight by about 1.25 to 2.0. Typically, the maximum amount of force applied multiplies the effective weight by about 2.5 more or less. Where the implement and the vehicle are sufficiently strong to accommodate stronger forces, same is contemplated herein; but will be the exception rather than the rule, with conventional implements.

Those skilled in the art will now see that certain modifications can be made to the apparatus and methods herein disclosed with respect to the preferred embodiments, without departing from the spirit of the instant invention.

And while the invention has been described above with respect to its preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. An implement interface providing means for raising and lowering an implement pivotally attached to a vehicle and also applying variable downward and upward forces to said implement as desired under varying conditions, comprising:

a compression spring, first and second spring actuators (58, 62) engaged with opposite ends of said spring to be urged apart thereby, means (70) limiting separating movement of said actuators, a lift arm (30) pivotally secured at one end to the vehicle at a location vertically spaced from said implement attachment thereto, means (90) pivotally securing said first actuator (58) to said implement forwardly of its pivotal attachment to the vehicle, means (102) pivotally securing said second actuator (62) to the other end of said lift arm, and, piston means, pivotally connected at one end to said lift arm and connected at the other end to said vehicle,,(18) for pivoting said lift arm with respect to said vehicle and toward and away from said first actuator, thereby selectively moving said second actuator downwardly and compressing said spring to apply added downward force to said implement, or, moving said actuator upwardly permitting said compression spring to separate said actuators and reduce downward force on said implement, or, upon operation of the means limiting separating movement of said actuators, thereby to cause elevation of said implement by pivotal movement with respect to said vehicle.

2. An implement interface as in claim 1, said limiting means comprising longitudinal slot means in one of said first and second spring actuators, said slot means having an end in said one spring actuator, hole means in the other of said first and second spring actuators, and bolt means extending through said hole means and said slot means, said bolt means being slidable in said slot means in cooperation with longitudinal movement of said spring actuators with respect to each other.

3. The implement interface of claim 1 wherein said means limiting separating movement of said actuators is constructed and arranged to leave said spring under partial compression at the limits of actuator separation.

* * * * *